US005296666A

United States Patent [19]

Varadan et al.

[11] Patent Number: 5,296,666

[45] Date of Patent: Mar. 22, 1994

[54] MICROWAVE HEATING APPARATUS HAVING TWO CAVITIES AND METHOD OF USING THE SAME

[75] Inventors: Vijay K. Varadan; Vasundara V. Varadan, both of State College; Thomas L. Schaffer, Osceola Mills, all of Pa.

[73] Assignee: The Pennsylvania Research Corporation, University Park, Pa.

[21] Appl. No.: 877,852

[22] Filed: May 4, 1992

[51] Int. Cl.[5] ..... H05B 6/80

[52] U.S. Cl. ..... 219/696; 219/701

[58] Field of Search ..... 219/10.55 R, 10.55 A, 219/10.55 F, 10.55 M; 156/272.2, 272.4, 379.6, 379.7

[56] References Cited

U.S. PATENT DOCUMENTS

| | | | |
|---|---|---|---|
| 2,856,497 | 10/1958 | Rudenberg | 219/10.55 F |
| 3,777,099 | 12/1973 | Levinson | 219/10.55 R |
| 3,845,266 | 10/1974 | Derby | 219/10.55 E |
| 4,256,944 | 3/1981 | Brandon | 219/10.55 F |
| 4,596,690 | 6/1986 | Liu . | |
| 4,752,663 | 6/1988 | Meisel | 219/10.55 F |
| 4,803,324 | 2/1989 | Fujii et al. | 219/10.55 F |
| 4,866,231 | 9/1989 | Schneider | 219/10.55 A |

FOREIGN PATENT DOCUMENTS

WO84/03426 of 0000 PCT Int'l Appl. .

OTHER PUBLICATIONS

V. K. Varadan & V. V. Varadan, "Microwave Joining and Repair of Composite Materials", *Polymer Engineering and Science*, mid-Apr. 1991, vol. 31, No. 7, pp. 470–486.

*Primary Examiner*—Philip H. Leung
*Attorney, Agent, or Firm*—Thomas J. Monahan

[57] ABSTRACT

A system is provided for heating non-metallic material or a discrete layer of the non-metallic material. Microwave energy is introduced into an enclosure defining a first cavity and capable of substantially containing the microwave energy. A semiconductive sheet is positioned at the bottom of the first cavity. Thermal insulation overlies the semiconductive sheet. A second cavity is defined by the undersurface of the semiconductive sheet and flexible microwave shielding in the form of a skirt which is attached to, and depends from, the enclosure. The flexible shielding is composed of a material which also substantially contains the microwave energy. The semiconductive sheet is effective to convert some of the microwave energy into thermal energy and to transmit the thermal energy into the second cavity while transmitting the remainder of the microwave energy directly to the discrete layer, thereby rapidly heating the discrete layer. The system includes a carriage with a handle for moving the apparatus across a surface of the non-metallic material and for adjusting the height of the semiconductive sheet above the surface of the non-metallic material.

23 Claims, 4 Drawing Sheets

MICROWAVE HEATING APPARATUS HAVING TWO CAVITIES AND METHOD OF USING THE SAME

BACKGROUND OF THE INVENTION

1. Field of the Invention

The present invention relates generally to a system for heating a non-metallic material and, more particularly, to such a system which is capable of rapidly heating a discrete layer of the material.

2. Description of the Prior Art

In recent years there has been an increasing trend in fabricating industrial components out of synthetic materials instead of metals and alloys. These materials can be tailored to meet special properties or combinations thereof be they physical, mechanical, electrical, or thermal. They can also be mass produced to suit automation techniques. For equivalent mechanical strength, their lower density results in light-weight structures. Moreover, highly complex parts, even with built-in metallic components when necessary, can be made with simple molding techniques at relatively lower processing temperatures than are usual in metal processing. Most of these synthetic materials are chemically inert. Multilayered systems and composites can be made to satisfy very stringent specifications at a much lower cost. Since the performance requirements are quite diverse, most of these materials are advanced non-metallic, ceramic, and polymeric composite materials. Unfortunately, components made of these materials cannot be united by conventional methods that have been developed for metal components.

In particular, high performance composites used in aerospace applications have generally been thermoset-resin based, although thermoplastics are now coming into use. Thermoplastic materials offer considerable advantages over the frequently used thermosetting composites because they are cheaper, have greater damage tolerance, and can be molded and remolded.

Thermoplastics tend to be fairly plastic and chemically inert, and are in essence, long-chain polymers with simple monomeric units. When heated, these materials soften and can be easily formed into complex shapes. Marginally defective thermoplastic laminates can be reprocessed by heating and be brought up to specifications thereby reducing waste. In contrast, thermosetting materials undergo chemical reactions during part processing, and cure or harden by forming complex cross-linking bonds; consequently, remolding is impossible. Further, volatile gases generated during the initial curing process may be trapped within the material resulting in mechanical and structural weakness. Because thermosetting plastics were used in conventional composites, welding of plastics did not receive much attention in the past; joining was based on adhesive bonding and mechanical fastening.

The joining, removal and repair of such a class of materials is a challenge to presently used welding methods. Often the size and shape of the structure, whether the materials to be joined are similar or dissimilar, thickness of material, non-metallic materials, temperatures the materials can withstand, the heating of the whole structure rather than the area to be joined, removed or repaired and the introduction of foreign, often undesirable, materials are problems with currently used methods such as arc welding, ultrasonic welding, induction welding, laser welding, and the like. In this disclosure, we propose a user safe, portable microwave system that can be used on a variety of materials in a variety of applications.

Considering one possible application, plastic, vinyl, and ceramic flooring overlayments have been used extensively in homes, hospitals, and commercial buildings. They offer a durable and easy-to-clean surface that is comfortable to walk on yet pleasing to the eye. These flooring sheets are attached to an underlayment such as wood or concrete by special adhesives. Using existing techniques, the adhesives require a long curing time for a proper bond. With our microwave system, however, this curing time can be reduced, yielding more efficient floor applications.

Further, the conventional removal of existing flooring can present even greater problems. To remove flooring it is necessary to heat the adhesive layer to its softening point. The flooring material can then be lifted from the underlayment. Conventionally, the heat has been applied from the top surface by using gas blow torches or super hot air blowers. This unfortunately causes the flooring material to scorch, producing toxic fumes.

An even greater problem is experienced in removing asbestos layered flooring. Unless the adhesive is completely softened, the asbestos breaks apart before the adhesive layer separates. This releases deadly asbestos dust in the air, endangering the workers as well as the tenants. In an effort to reduce this risk, flooring is often soaked with water to reduce the dust created. Unfortunately, not only is this a great mess in which to work, but often results in water damage to the underlayment material.

Our invention avoids all of these problems. The microwave energy from our system penetrates the surface layer and preferentially heats the adhesive layer directly. This leads to greater adhesive debonding without surface damage. Further, due to the more effective adhesive softening, asbestos coated tiles can be removed without separating the asbestos layer from its protective backing. For important background information relating to the use of microwave energy in conjunction with composite materials, we refer you to the technical article "Microwave Joining and Repair of Composite Materials" by Vijay K. Varadan and Vasundara V. Varadan, *Polymer Engineering and Science,* Mid-April 1991, Vol. 31, No. 7, pp. 470–486. The entire disclosure of this technical article is incorporated herein by reference.

SUMMARY OF THE INVENTION

As referred to above, our invention facilitates fast, easy, and safe adherence as well as removal of flooring materials to an underlayment substrate. The invention utilizes a multimode microwave cavity, an optimized microwave applicator, and extensive safety devices, all mounted on a portable system frame.

The multimode cavity is fed by a microwave magnetron, coupled through a wave launcher in the cavity. This cavity acts as a reservoir to store the electromagnetic energy. From this reservoir, an aperture has been opened to a second cavity having optimized dimensions most closely matching the impedance of the flooring load. The transfer of power from the multimode cavity through this aperture is then at its maximum. The multimode cavity has been partially filled with a suitable thermally insulating, yet microwave transparent, material to minimize heat build-up inside the cavity.

The applicator is attached to the multimode cavity via the aperture. The applicator includes a high temperature material in sheet form which is coated with a thin semiconducting layer such as doped tin oxide. This coating enables the applicator to absorb a portion of the electromagnetic energy. The applicator then represents a constant load to the magnetron allowing good coupling over a variety of surface substrates, yet protecting the magnetron with a built in load. The coating can be any semiconducting material that acts as a load on the magnetron and allows partial transmission of microwaves.

Additionally, this applicator heats as it absorbs the electromagnetic energy. The thermal energy from the applicator is imparted to the second cavity. This begins to warm the flooring substrate which in turn increases its own ability to absorb the microwave energy directly. The fringing microwave field that passes through the applicator can then heat the adhesive layer of the flooring directly.

To protect against any microwave leakage from the portable system, we have incorporated several safety devices. The first of these is a flexible shield attached around the perimeter of the microwave system. The flexibility of this shield allows good contact with the floor, while the electromagnetic properties prevent passage therethrough of any microwave energy.

To insure proper positioning as well as close proximity to the floor during activation, the unit can be raised when moved, and lowered when energized. To prevent activation when the unit is raised, two floor sensors have been fastened to the microwave system. If the flooring is not in good contact with the aperture, the unit will not energize. Further, if the unit is moved during operation such that a sensor is tripped, the unit will shut down immediately and not restart until all safety devices are satisfied and the unit is reset.

As an additional precaution, a microwave leakage detector may be incorporated into the power controller. If microwave leakage over 4 $mW/cm^2$ is detected, the unit automatically shuts off and signals the leakage. This preset leakage level is below the OSHA safety regulation of 5 $mW/cm^2$. Also, the activation may be timer operated to prevent any unattended, long period operation.

In a further effort to describe our invention, it is considered desirable to provide the following additional background information.

The power delivered as heat to a material depends on the relevant microwave properties of the material. In our work, these properties are the permittivity $\epsilon$, the permeability $\mu$, and the chirality parameter $\beta$. For simplicity, we have considered the composite materials to have a magnetic permeability equal to that of free space. This approximation is valid for most applicable polymers. The parameters of interest, then, are the permittivity and the chirality.

For the microwave heating, when only magnitudes are important, the chirality parameter at any given frequency can be taken into account conveniently by the use of a redefined permittivity, provided the chirality parameter is not too large. This allows the use of the more common electromagnetic equations and simplifies the analysis.

The permittivity can be separated into its real and imaginary components. The real part is termed the dielectric constant and can roughly be defined as a measure of how microwaves propagate in the polymer and how much electric polarization is induced in the material. This effect, however, does not necessarily produce heat. The imaginary part of the permittivity is a measure of the absorption of microwave power in the medium as the wave passes through the polymer. For a relative comparison, the imaginary portion divided by the real portion is termed the loss tangent and is indicative of the amount of heat produced in the material. A more exact measure of the heat developed in a polymer by microwave irradiation is given by $$\rho C_p 7T/\partial t = \omega\epsilon''|E|^2 + \omega\mu''|H|^2 + \nabla\cdot(\kappa_h \nabla T)$$

where $\partial T/\partial t$ is the time rate of change of the temperature, $\omega$ is the angular microwave frequency, $\oplus''$ in the imaginary part of the permittivity (low factor), $\mu''$ is the imaginary part of the permeability (magnetic loss factor), E is the electric field in the medium, H is the magnetic field in the medium, $\rho$ is the mass density of the polymer, $C_p$ is the specific heat at constant pressure, and $\kappa_h$ is the thermal conductivity.

Care must be taken to realize that in the above expression, the heat generated in the medium is dependent on the electric field E inside the medium. Turn to FIG. 1 which depicts a plurality of adjacent media A,B,C,D representing layers of a composite material 20. In the composite material 20, the field inside medium D depends on conditions in medium C which, in turn, depends on the conditions in medium B, which in turn depends on the conditions of medium A.

The propagation of an electromagnetic wave from one material into another material depends on the relative impedances of the two materials. Mathematically, the intrinsic impedance of a material is given as $$\eta = \sqrt{\mu/\epsilon}$$

If the materials have identical impedances, then the wave travels forward, with no reflection at the interface, into the new material. With increased impedance mismatch, the wave is both decreasingly transmitted and increasingly reflected back toward the source. It is this interdependence of materials that allow the absorption of microwave power at some discrete layer within a polymer composite while leaving the remaining layers relatively unaffected.

Using the intrinsic impedance of a material it is possible to construct the impedance of two or more composite layers grouped together as seen by the incoming wave. This bulk impedance can be derived from transmission line theory and is given as $$Z_i = Z_0[(Z_{i+1} + Z_0 \tanh(\gamma 1))/(Z_o + Z_{i+1} \tan h(\gamma 1))]\Omega$$

with $$\gamma = j\omega\sqrt{\mu\epsilon}$$

where $Z_i$ is the input impedance at layer i, $Z_0$ is the characteristic impedance of the incoming wave, $Z_{i+1}$ is the impedance of the "remaining medium", $\gamma$ is the propagation constant, and 1 is the distance to the medium. In this case, the "medium" is the combination of layers from the interface of interest to the far side of the composite. If this impedance closely matches the impedance of the incoming wave, then propagation can occur, that is, it can penetrate the layer without reflection. Thus by selectively choosing the properties of the composite layering, and by changing the impedance of the incoming wave, we can alter the effect that the microwave energy has on the material.

Using these wave/material properties, a multilayer material can be designed so as to have the loss tangent of each layer increase with its depth from the surface. Normally, the deepest layer would heat the most, but by controlling the impedance of the incoming wave, the attenuation of the wave can be controlled. It is, therefore, the material layer with the greatest electric field and loss tangent combination that will have the most heating.

As the layers of the composite begin to heat, the dielectric properties of the layers change. For most materials, the dielectric loss factor increases with increasing temperature. From the first equation above, then, as the loss factor increases, more energy is absorbed and the temperature rises even greater. This also decreases the electrical field that passes into subsequent layers. For this reason, the desired layer need not have tremendously increased loss, but will become the absorbing layer by virtue of this temperature dependent loss.

There are ways in which the loss tangent in the host polymer material layer can be altered. Although some polymers such as ABS, EEA, PMMA possess sufficient loss, many polymers are intrinsically non lossy. Methods available for increasing the loss in a material include adding artificial absorption through EM conductive additives, or enhancing the natural properties of the polymer through geometric dispersive or scattering additives. To impart an electrical conductivity to the polymer, which contributes to the dielectric loss, additives containing electron withdrawing groups (nitrile, carboxyl, and carbonyl) can be added to the polymer blend. The electrical conductivity of the polymer greatly increases the microwave absorption. Alternately, doping a polymer with a small amount of a more polar polymer may add the necessary loss. To enhance the natural absorption of a polymer, scatterers can be added to the polymer. The scatterers themselves do not absorb the microwave energy, but they do congest the path for the microwaves allowing the natural polymer effects to be more pronounced.

For applications where the absorption of the material cannot be altered, we have developed a unique applicator design. This applicator contains a lens between the source and the composite material. The amount of absorption in the lens depends on the amount of microwave reflection from the surface of the composite, and thus on the composite properties. Therefore, if the composite is very badly matched, the lens absorbs the most heat. This increases the temperature of the lens. This energy is transferred to the composite surface as IR heat. As the composite absorbs the IR heat, its temperature begins to rise, and with more molecular motion possible, its intrinsic loss begins to rise. The increase in the composite loss decreases the reflection until, after a short time, the system is in equilibrium and the composite receives the maximum amount of microwave radiation.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of the invention, illustrate some of the embodiments of the invention and, together with the description, serve to explain the principles of the invention in general terms. Like numerals refer to like parts throughout the disclosure.

DETAILED DESCRIPTION OF THE PREFERRED EMBODIMENT

Figure 2:
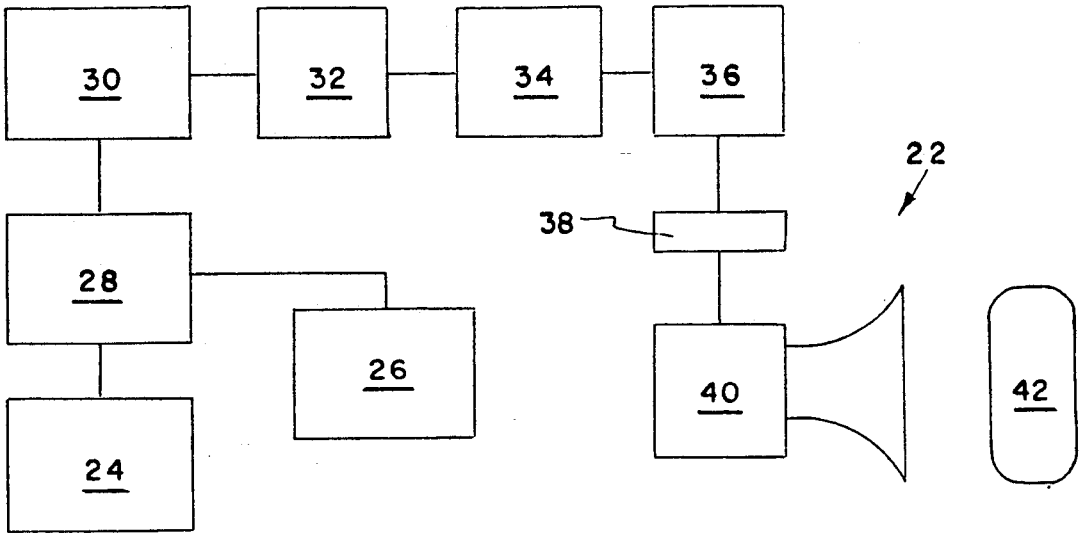
FIG. 2 is a schematic diagram of a microwave system capable of energizing the apparatus of the invention.

Turn now to the drawings and, initially at this point, to FIG. 2 which schematically represents a microwave system 22 capable of supporting the invention. The system 22 includes a D.C. power source 24, a 110-volt A.C. supply 26, a power supply 28, and a microwave power generator 30 which may typically be a magnetron tube.

Magnetron tubes have the highest efficiency of all microwave tubes, have a long operating and shelf life, are much smaller in size, require the least amount of circuitry and circuit components, and require only simple voltage sources for operation. Magnetrons can withstand wide temperature variations and are rugged and relatively insensitive to the vibration and shock conditions in the field. The frequency spectrum of a magnetron is, however,, not as narrow as that of a klystron or a traveling wave tube or a gyratron. But that does not affect the performance, that is, heating ability of the magnetron-based system so long as a high-Q-cavity applicator is not used. Magnetrons are also considerably cheaper than other microwave tubes.

A further component of the system is a ferrite isolator 32. A ferrite isolator is a microwave device that allows the power at its input port to flow to the output port with very little attenuation. But any microwave power entering from its output port is absorbed in its built-in load and does not propagate back through its input port. Since any power reflected back into the magnetron will overheat its cathode and reduce its operating life, the isolator shields the magnetron tube from the deleterious effects of any impedance mismatch between the source and the effective load. For high-power systems, a microwave circulator with water cooling and a matched load is the appropriate choice.

A forward reflected power indicator 34 comprises a compact directional coupler that samples the microwave power going to, or reflected back from, the applicator side. These microwave signals are detected by microwave crystal detectors and their output can be indicated by a meter. The indicator is required for monitoring the microwave system 22 while it is in operation.

For maximum transfer of microwave power from the source to the applicator, and hence to the work load, a tuner 36 can be adjusted to minimize the reflected power. In this condition the impedance of the source is nearly equal to the effective load impedance. This impedance depends on various factors, such as the characteristics of the applicator, the type and composition of the material being processed, its dimensions, the coupling of the applicator to the material, and other factors not of immediate concern. After preliminary experimentation, the tuner 36 can be preset at several positions to account for common load types.

A variable-coupling iris 38 may be incorporated into the system to optimize and adjust the power coupled to the system for delivering power for different applications. The power can be focused on the interfaces to be joined or separated. The components to be joined must be good absorbers of microwave energy at least at the interface if not throughout the volume.

An applicator 40 concentrates the microwave power into the area to be heated, represented by a target 42 of non-metallic material, heating it rapidly to a desired temperature. If the target 42 is of a multi-layered construction, the system of the invention can achieve its goals of affecting predetermined layers of the target while leaving other layers substantially unaffected.

Figure 1:
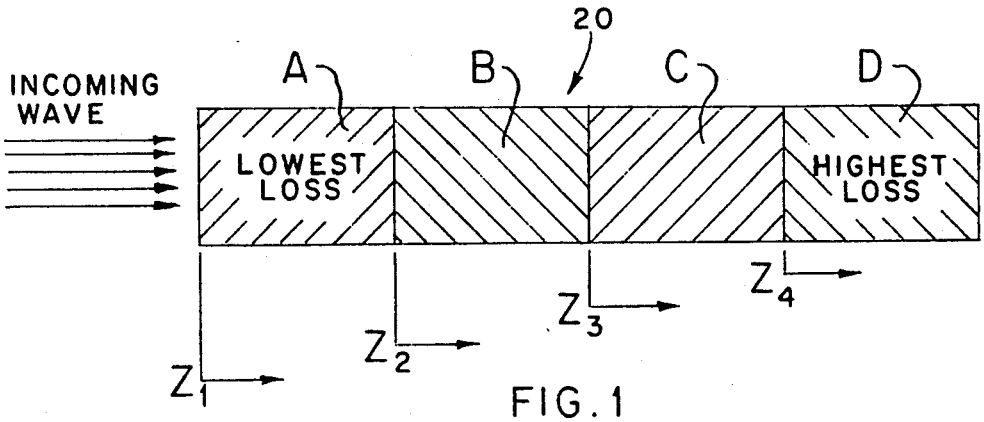
FIG. 1 is a diagrammatic cross section view taken through a multi-layered composite material to demonstrate the impedance relation among the layers when they are subjected to an incoming wave of electromagnetic radiation, specifically, microwave radiation.
Figure 3:
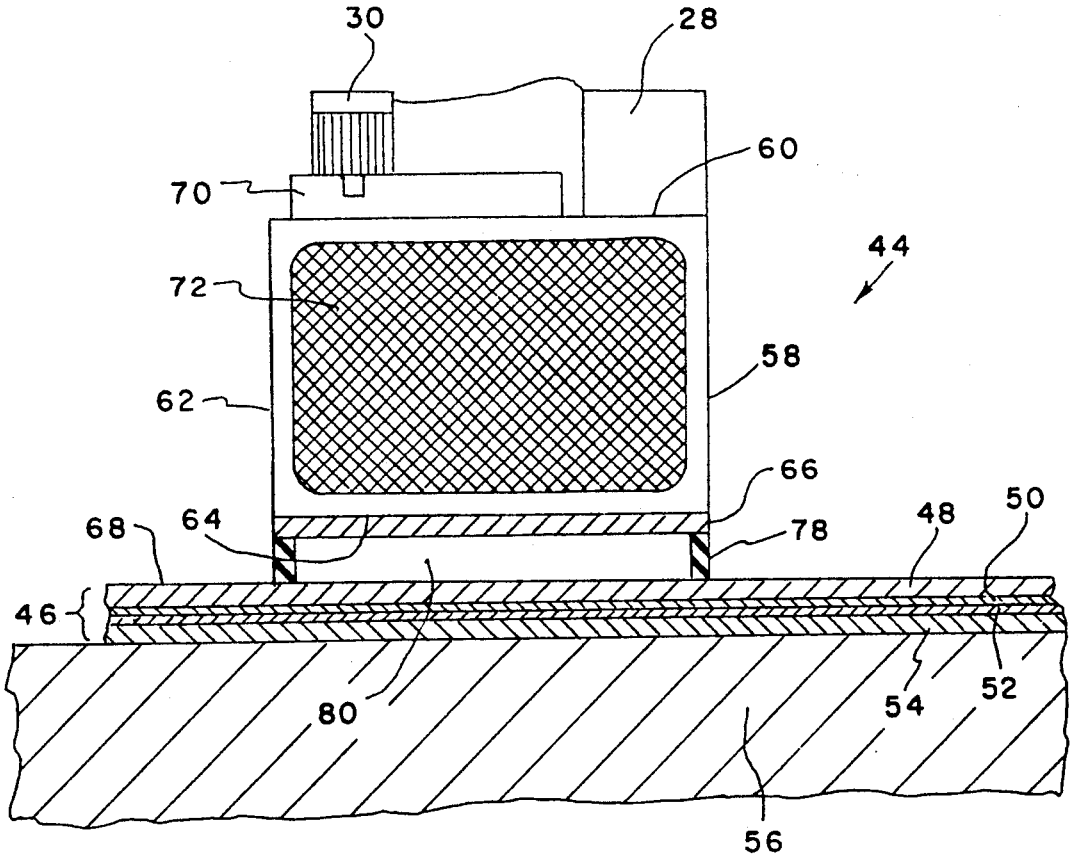
FIG. 3 is an elevation view of microwave heating apparatus embodying the invention, certain parts being cut away and shown in section, and also the underlying surface on which the apparatus rests.

Turning now to FIG. 3, the microwave system 22 just described may be utilized in combination with apparatus 44 intended for rapidly heating a broad expanse of an underlying non-metallic material 46. The material 46 is typically, although not necessarily, of a multilayered composite construction comprising discrete layers 48, 50, 52, and 54 supported on an appropriate underlayment 56. In the event the material 46 is intended to be a floor covering, the underlayment 56 would typically be wood or concrete, but in any event would not be metallic.

The purpose for the heating apparatus 44 is for either applying the material 46 to the underlayment 56 at the time of installation or removing the material 46 from the underlayment 56 for its disposal and replacement. In this context, it is desired to remove one or more of the layers from its adjoining layer or the entire layered material 46 from the underlayment 56. In any event, it is desirable to heat adhesive material which is present between the layers so as to soften it and enable the separation, with ease, of the adjoining layers.

To this end, the heating apparatus 44 comprises a suitable enclosure 58 capable of substantially containing microwave energy within its interior. The enclosure 58 has a top 60 and a sidewall 62 integral with the top and extending downwardly to a lowermost rim 64. A semiconductive sheet member 66 is fixed to the sidewall 62 and lies in a plane generally parallel to and spaced from and underlying surface 68 of the material 46. The microwave power generator 30, preferably in the form of a magnetron, and its associated wave launcher 70 may be mounted on the top 60 of the enclosure 58 and is effective to direct microwave radiation into the interior of the enclosure. Thermal insulating material is provided at least adjacent an upper surface of the semiconductive sheet 66 and, preferably, completely fills the interior of the enclosure 58. The interior of the enclosure 58 thus filled may be referred to as a first cavity and is a multimode cavity. The thermal insulating material 72 may be suitable microwave transparent thermal insulation such as that manufactured and sold under the trademark FIBERFRAX by Carborundum Corporation of New Carlisle, Ind.

It will be appreciated that the applicator 40 of the apparatus 44 is a combination of the semiconductive sheet 66 and of the thermal insulating material 72. For its part, the semiconductive sheet 66 is comprised of a generally planar sheet member 74 composed of relatively low dielectric constant, high temperature, material 74 which may be a silica based composition such as quartz or material manufactured and sold under the trademark PYREX by Corning Glassworks of Elmira, N.Y. The thin film susceptor 76 is applied to a surface of the sheet member 74. The thin film susceptor is a suitable semiconductive film which may be, for example, tin oxide or zinc oxide doped with Indium or antimony or with other suitable conductive doping material.

In order to protect operating personnel from the effects of microwave radiation, a flexible microwave shield in the form of a skirt 78 is suitably attached to the lowermost rim 64 of the enclosure 58 to thereby define a second cavity 80. The skirt 78 is of a length sufficient to at least engage the underlying surface 68. The skirt 78 is flexible and of a length to assure that it will always engage the underlying surface 68 regardless of the contours therein as the apparatus 44 is moved across the material 46.

Numerous compositions are known which provide electromagnetic and radio frequency interference (EMI/RFI) shielding. A disclosure of a typical conductive thermoplastic composition providing improved effectiveness at high frequencies is presented in U.S. Pat. No. 4,596,670. According to this patent, the improved properties expressed are said to be obtained by the incorporation of conductive carbon powder in conductive thermoplastic compositions wherein the latter comprises a thermoplastic polymer having incorporated therein a synergistic combination of metal flakes and one or more conductive fibers, preferably metal or metal coated fibers.

For purposes of the present invention, a preferred material for use in electromagnetic shields is commercially available from HVS Technologies Inc. of State College, Pa. under the product designation HVS-5000.

In accordance with the invention, the dimensions of the second cavity 80 are chosen so as to assure an impedance match with the underlying material 46.

In the operation of the heating apparatus 44, microwave energy is directed into the first cavity and, by means of the semiconductive sheet 66, part of the microwave energy is converted into thermal energy and directed into the second cavity 80. The remainder of the microwave energy passes through the semiconductive sheet 66 and into the non-metallic material 46. With the impedance of the second cavity 80 matched with that of a specific one of the layers 48, 50, 52, and 54 of the material 46, the microwave energy is directed into that specific, or discrete, layer. As the discrete layer is heated by the thermal energy, its loss constant increases enabling it to absorb more and more of the microwave energy. In a short time, there is a cascading effect enabling the temperature to rise very rapidly thereby achieving the goal sought.

Figure 6:
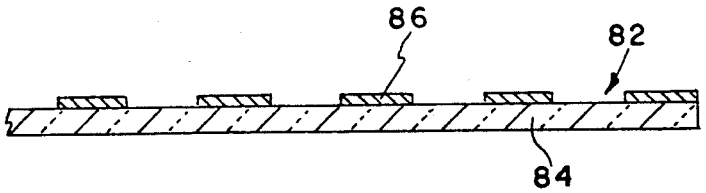
FIG. 6 is a cross section view taken generally along lines 6—6 in FIG. 5.
Figure 4:
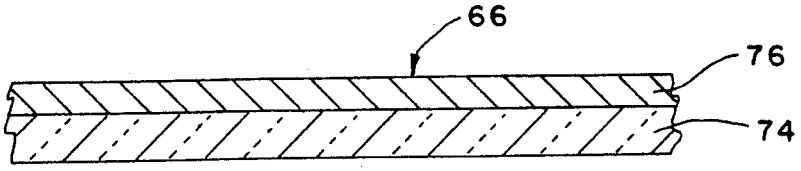
FIG. 4 is a detail cross section view of one component utilized by the apparatus illustrated in FIG. 3.
Figure 5:
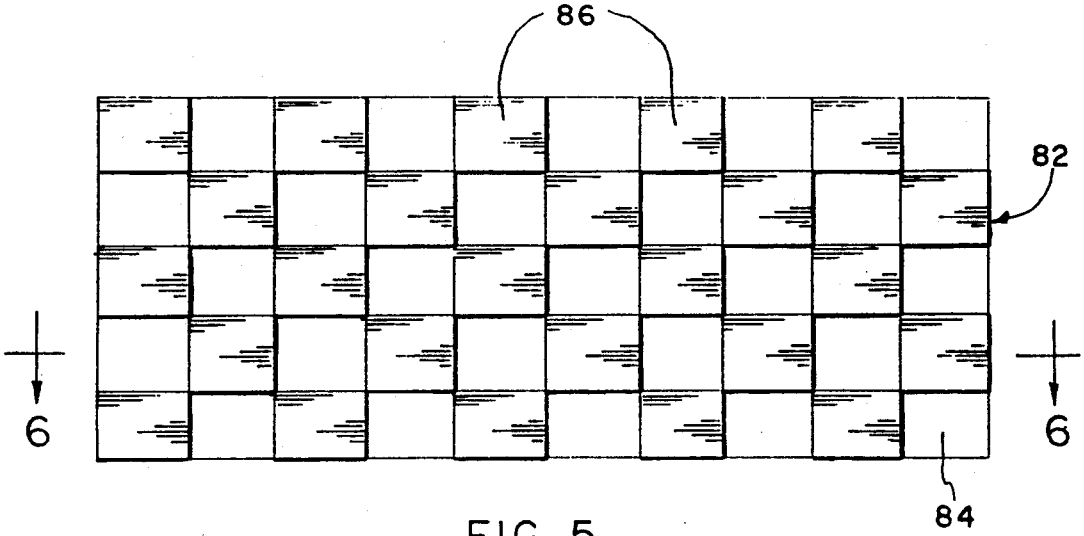
FIG. 5 is a top plan view of a modified component of the invention.

In another embodiment illustrated in FIGS. 5 and 6, a modified semiconductive sheet 82 may be utilized to more accurately focus the microwave energy onto a discrete layer of the material 46. In this instance, the sheet 82 comprises a sheet member 84 of a relatively low dielectric constant, high temperature, material to which patches 86 of a suitable thin film susceptor are selectively and periodically deposited in uniformly spaced arrangement. In this manner, the thin film susceptor material serves as a microwave grating capable of focusing the microwave energy at a desired distance from the semiconductive sheet. For this embodiment, the size and spacing of the conductive patches 86 determines the focal length of the system.

Figure 5A:
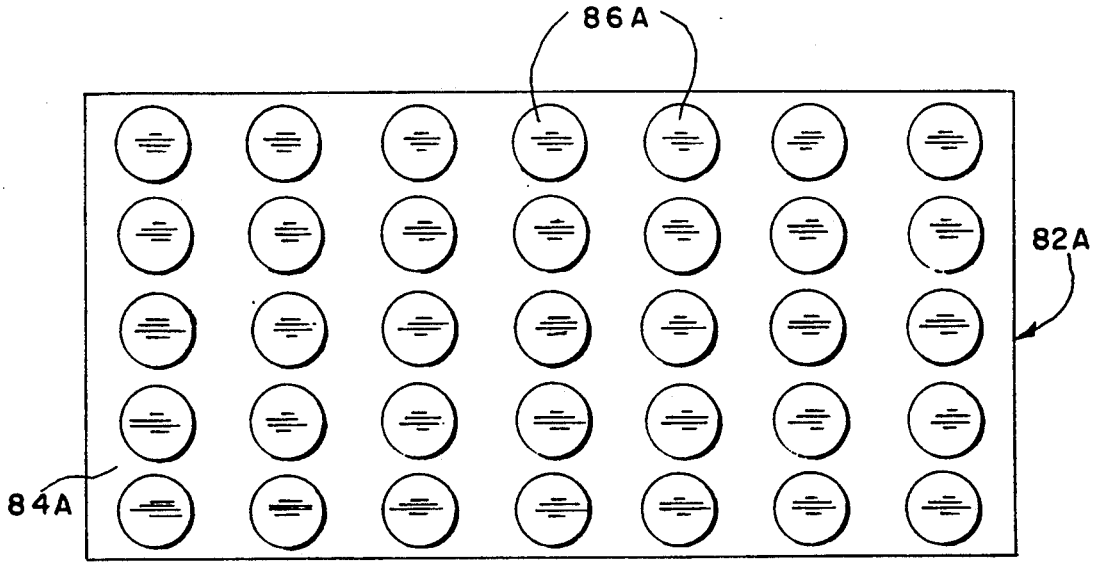
FIG. 5A is a top plan view of another modified component of the invention.

Still another embodiment is illustrated in FIG. 5A in which a modified semiconductive sheet 82A is similar to sheet 82 with the exception that patches 86A of a thin film susceptor are circular rather than square or rectangular. Patches of other shapes can also be utilized.

Figure 7:
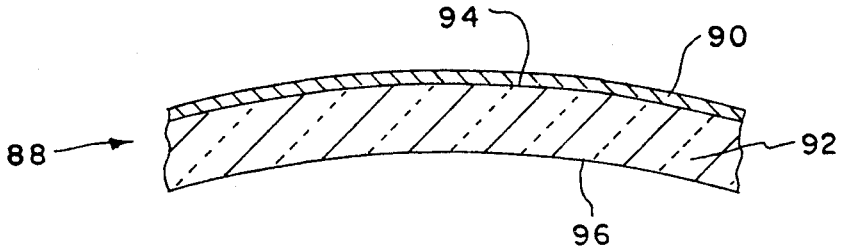
FIG. 7 is a detail cross section view of still another embodiment of a component of the invention.

Yet a further embodiment of the invention is illustrated in FIG. 7 which illustrates yet another modified semiconductive sheet 88. In this instance, thin film susceptor material 90 is continuous and overlies in a coextensive manner a sheet member 92 composed of a relatively low dielectric constant, high temperature, material. In this instance, one or more of surfaces 94, 96 of the sheet member 92 are appropriately contoured in order to focus the microwave energy on a specific layer of the material 46.

Figure 8:
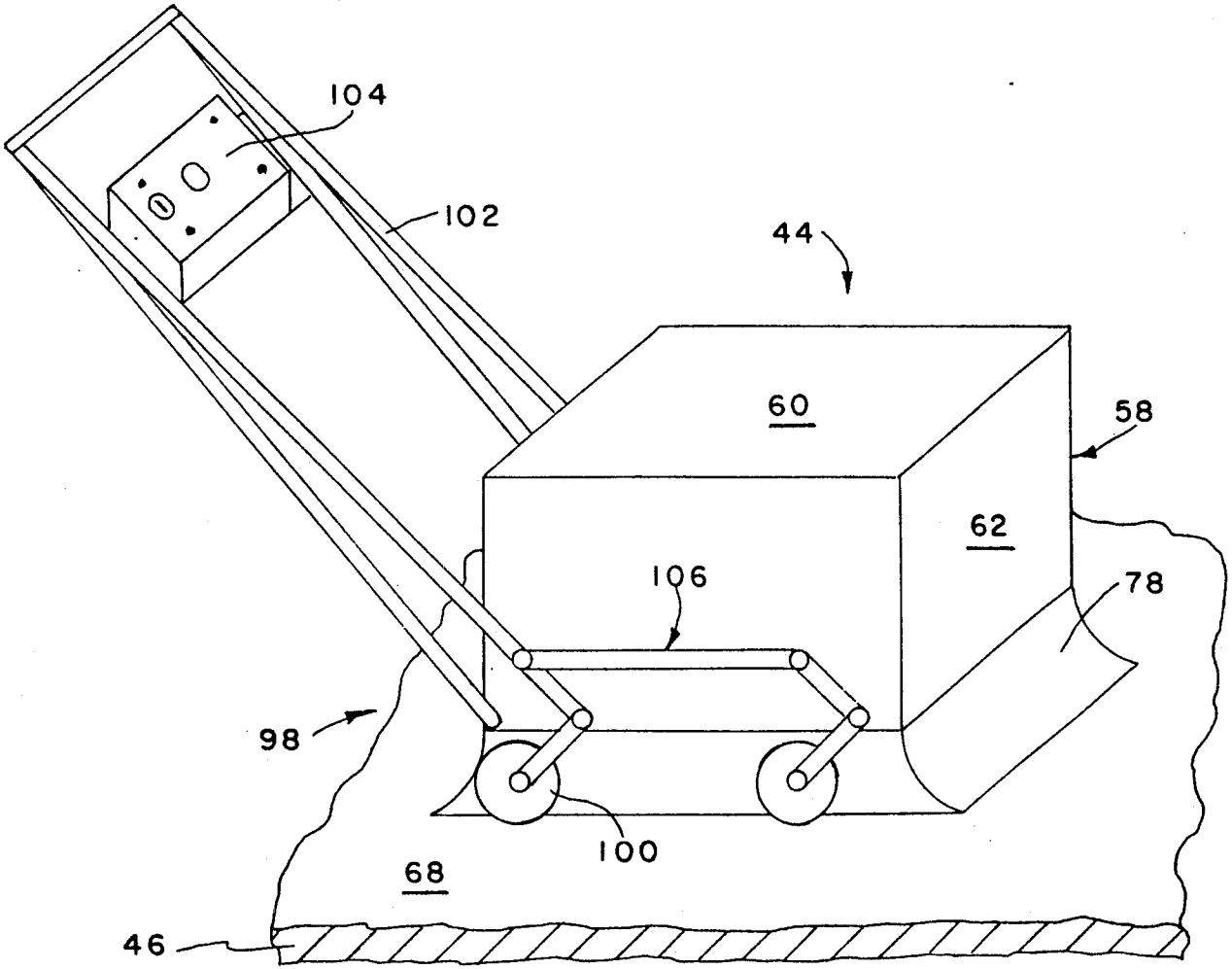
FIG. 8 is a diagrammatic perspective view illustrating a proposed commercial unit embodying the invention.

In order to rapidly and efficiently move the heating apparatus 44 across the underlying surface 68 of a material 46, it is desirable to provide it with a carriage 98 which may be of a construction such as that illustrated in FIG. 8. Specifically, it would be desirable to support the heating apparatus 44 on wheels 100 while providing a handle 102 for guiding it across the surface 68 and for supporting a control unit 104 for operating the apparatus. A linkage 106 or other suitable mechanism may be operated through the handle 102 for raising and lowering the enclosure 58 relative to the surface 68. In this manner, the impedance of the second cavity 80 can be matched to that of the discrete layer of the underlying material 46.

In this manner, a rapid, yet highly effective manner of either laying or removing floor coverings can be achieved, whether such floor coverings be carpeting, linoleum, tile, or other suitable sheet material.

While the preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. Apparatus for heating an underlying material comprising:

an enclosure capable of substantially containing microwave energy therein having a top, at least one sidewall integral with said top and extending downwardly therefrom to a lowermost rim, and an applicator means integral with said sidewall, said enclosure defining a first cavity;

a source of microwave radiation capable of emitting microwave energy into said enclosure; and microwave shielding means fixed to said lowermost rim of said enclosure and capable of extending to the underlying surface, said shielding means and said applicator means together defining a second cavity, said shielding means capable of substantially containing microwave energy in the second cavity;

said applicator means capable of receiving and converting a portion of microwave energy from said source to thermal energy and of transmitting said thermal energy into the second cavity and of transmitting a portion of the microwave energy into the second cavity;

the first cavity being adjacent the second cavity with said applicator means separating the first and second cavities.

2. Apparatus for heating as set forth in claim 1 wherein said applicator means includes:

semiconductive sheet means fixed to said sidewall generally parallel to and spaced from the surface of the underlying material.

3. Apparatus for heating as set forth in claim 2 wherein said semiconductive sheet means includes:

a sheet member composed of relatively low dielectric constant, high temperature, material; and a thin film susceptor applied to a surface of said sheet member.

4. Apparatus for heating as set forth in claim 3 wherein said thin film susceptor includes at least one of tin oxide and zinc oxide doped with indium or antimony.

5. Apparatus for heating as set forth in claim 3 wherein said sheet member is composed of a material selected from the group consisting of boron oxide containing glass and a silica based composition.

6. Apparatus for heating as set forth in claim 2 wherein said applicator means includes thermal insulating means overlying and contiguous with said semiconductive sheet means and generally coextensive therewith.

7. Apparatus for heating as set forth in claim 1 wherein said shielding means is composed of a mixture of conductive nickel-coated graphite fibers, nickel flakes, and conductive antimony-coated tin oxide powder dispersed in a cured elastomeric matrix.

8. Apparatus for heating as set forth in claim 1 wherein said shielding means is an elastomeric-based material capable of shielding microwave energy to the extent of at least 95 to 110 dB at the frequency of operation.

9. Apparatus for heating as set forth in claim 1 wherein the first cavity defined by said enclosure is a multimode cavity.

10. Apparatus for heating as set forth in claim 1 wherein said applicator means includes:

means for focusing part of the microwave energy onto the underlying non-metallic material.

11. Apparatus for heating as set forth in claim 10 wherein said focusing means includes:

semiconductive sheet means having a focal length capable of focusing the microwave energy at the distance of the underlying non-metallic material.

12. Apparatus for heating as set forth in claim 11 wherein said semiconductive sheet means includes:

a semiconductive sheet member composed of relatively low dielectric constant, high temperature, material, said sheet member having at least one contoured surface for focusing the microwave energy; and a continuous thin film susceptor deposited onto said surface of said sheet member and substantially coextensive therewith.

13. Apparatus for heating as set forth in claim 10 wherein said focusing means includes:

a semiconductive sheet member composed of relatively low dielectric constant, high temperature, material; and a thin film susceptor selectively and periodically deposited onto said sheet member in uniformly spaced patches such that the thin film susceptor comprises a microwave grating capable of focusing the microwave energy at a desired distance, the size and spacing of said conductive patches determining the focal length thereof.

14. Apparatus for heating as set forth in claim 1 including:

means for adjusting the height of said applicator means above the surface of the underlying material.

15. Apparatus for heating as set forth in claim 1 wherein said microwave shielding means is flexible.

16. Apparatus for heat as set forth in claim 1 including:

carriage means for moving said enclosures across the surface of the underlying material.

17. Apparatus for heating an underlying material having multiple layers, said apparatus comprising:

an enclosure capable of substantially containing microwave energy therein having a top and at lest one sidewall integral with said top and extending downwardly therefrom to a lowermost rim, and an applicator means integral with said sidewall, said enclosure defining a first cavity;

a source of microwave radiation capable of emitting microwave energy into said enclosure; and shielding means fixed to said lowermost rim of said enclosure and capable of extending to an underlying surface of the non-metallic material, said shielding means and said applicator means together defining a second cavity, said shielding means capable of substantially containing microwave energy in the second cavity;

said applicator means for receiving and converting a portion of microwave energy from said source to thermal energy and for transmitting said thermal energy into the second cavity, said applicator means capable of transmitting a portion of microwave energy into the second cavity;

the first cavity being adjacent the second cavity with said applicator means separating the first and second cavities;

whereby a discrete layer of the underlying material becomes heated initially primarily from the thermal energy and becomes heated subsequently from both the thermal energy and the microwave energy.

18. A method of heating an underlying material comprising the steps of:

directing microwave energy into a first cavity defined in part by a semi-conductive member having overlying and continuous thermal insulating means associated therewith;

converting some of the microwave energy into thermal energy by the semiconductor member;

directing the converted thermal energy and the unaltered microwave energy into a second cavity adjacent the first cavity; and matching the impedance of the second cavity with that of the underlying material.

19. A method of heating an underlying material as set forth in claim 18 including the step of: shielding against transmission of the microwave energy into the environment outside of the second cavity.

20. A method of heating an underlying material having multiple layers comprising the steps of:

directing microwave energy into a first cavity defined in part by a semiconductor member having overlying and contiguous thermal insulating means associated therewith;

converting some of the microwave energy into the thermal energy by the semiconductive member;

directing the converted thermal energy and the unaltered microwave energy into a second cavity adjacent the first cavity; and matching the impedance of the second cavity with that of a discrete layer of the underlying material whereby the discrete layer becomes heated, substantially to the exclusion of adjacent layers, initially primarily from the thermal energy and becomes heated subsequently from both the thermal energy and the microwave energy.

21. A method of heating an underlying material comprising the steps of:

directing microwave energy into a first cavity defined in part by a semiconductive member having overlying and contiguous thermal insulating means associated therewith;

converting part of the microwave energy into thermal energy by the semiconductive member;

directing the thermal energy into a second cavity adjacent the first cavity;

focusing part of the microwave energy onto the underlying material; and matching the impedance of the second cavity with that of a discrete layer of the underlying material.

22. A method of heating an underlying material as set forth in claim 21 wherein the step of focusing part of the microwave energy onto the underlying material includes the step of:

shaping the semiconductive member into a microwave lens having a focus length capable of focusing the microwave energy at the distance of the underlying material.

23. A method of heating an underlying material as set forth in claim 21 wherein the semiconductive member includes a sheet member composed of a relatively low dielectric constant, high temperature, material; and wherein the step of focusing part of the microwave energy onto the underlying material includes the step of:

selectively and periodically depositing a thin film susceptor onto the sheet member in uniformly spaced patches such that the thin film susceptor comprises a microwave grating capable of focusing the microwave energy at a desired distance, the size and spacing of the conductive patches determining the focal length thereof.

* * * * *